US007244691B2

(12) United States Patent
Massa et al.

(10) Patent No.: US 7,244,691 B2
(45) Date of Patent: Jul. 17, 2007

(54) THERMAL PRINT ASSEMBLY

(75) Inventors: Dennis J. Massa, Pittsford, NY (US); Ramanuj Goswami, Webster, NY (US); Walter H. Isaac, Penfield, NY (US); Christine J. Landry-Coltrain, Fairport, NY (US); David M. Teegarden, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 96 days.

(21) Appl. No.: 11/017,590

(22) Filed: Dec. 20, 2004

(65) Prior Publication Data

US 2006/0135364 A1 Jun. 22, 2006

(51) Int. Cl.
*B41M 5/035* (2006.01)
*B41M 5/50* (2006.01)

(52) U.S. Cl. ..... 503/227

(58) Field of Classification Search ..... 503/227
See application file for complete search history.

(56) References Cited

U.S. PATENT DOCUMENTS

| | | | |
|---|---|---|---|
| 4,985,395 | A | 1/1991 | Vanmaele et al. |
| 5,026,677 | A | 6/1991 | Vanmaele |
| 5,082,823 | A | 1/1992 | Vanmaele et al. |
| 5,096,874 | A | 3/1992 | Kita |
| 5,142,089 | A | 8/1992 | Vanmaele |
| 5,256,622 | A | 10/1993 | Henzel |
| 5,294,588 | A | 3/1994 | Mori et al. |
| 5,308,736 | A | 5/1994 | Defieuw et al. |
| 5,354,725 | A | 10/1994 | Eguchi et al. |

FOREIGN PATENT DOCUMENTS

| | | |
|---|---|---|
| EP | 0 348 989 | 1/1990 |
| EP | 0 356 115 | 3/1990 |
| EP | 0 483 799 | 5/1992 |
| EP | 0 545 407 | 6/1993 |
| JP | 08034170 A | 2/1996 |

*Primary Examiner*—Bruce H. Hess
(74) *Attorney, Agent, or Firm*—Kathleen Neuner Manne; Lynne M. Blank

(57) ABSTRACT

A print assembly including a dye-donor element and a receiver element, wherein the print assembly has a donor having a dye-donor layer having a first glass transition temperature and at least one dye, and a receiver having a dye-receiving layer having a second glass transition temperature on a support, wherein the print assembly has a receiver/donor dye partition coefficient of at least 2.5 when the print assembly is heated above the higher of the first or second glass transition temperature for a time sufficient to achieve an equilibrium state of dye distribution between the dye-donor layer and dye-receiving layer. The print assembly can be used at fast print speeds of 2.0 msec/line or less.

29 Claims, No Drawings

THERMAL PRINT ASSEMBLY

CROSS REFERENCE TO RELATED APPLICATIONS

Cross-reference is made to related co-filed applications, U.S. application Ser. No. 11/017,070 to Isaac et al. Ser. No. 11/017,487 to Landry-Coltrain et al. and Ser. No. 11/017,377 to Teegarden et al.

FIELD OF THE INVENTION

A thermal print assembly including a dye-donor element having a dye-donor layer and a dye, and a receiver element having a dye-receiving layer, wherein the thermal print assembly has a partition coefficient of at least 2.5 when the thermal print assembly is heated above the highest glass transition point of the dye-donor layer or the dye-receiving layer to an equilibrium state of dye distribution between the dye-donor layer and the dye-receiving layer, is disclosed.

BACKGROUND OF THE INVENTION

Thermal transfer systems have been developed to obtain prints from pictures that have been generated electronically, for example, from a color video camera or digital camera. An electronic picture can be subjected to color separation by color filters. The respective color-separated images can be converted into electrical signals. These signals can be operated on to produce cyan, magenta, and yellow electrical signals. These signals can be transmitted to a thermal printer. To obtain a print, a black, cyan, magenta, or yellow dye-donor layer, for example, can be placed face-to-face with a dye image-receiving layer of a receiver element to form a print assembly, which can be inserted between a thermal print head and a platen roller. A thermal print head can be used to apply heat from the back of the dye-donor sheet. The thermal print head can be heated up sequentially in response to the black, cyan, magenta, or yellow signals. The process can be repeated as needed to print all colors, and a laminate or protective layer, as desired. A color hard copy corresponding to the original picture can be obtained. Further details of this process and an apparatus for carrying it out are contained in U.S. Pat. No. 4,621,271 to Brownstein.

Thermal transfer works by transmitting heat through the donor from the back-side to the dye-donor layer. When the dyes in the dye-donor layer are heated sufficiently, they sublime or diffuse, transferring to the adjacent dye-receiving layer of the receiver element. The density of the dye forming the image on the receiver can be affected by the amount of dye transferred, which in turn is affected by the amount of dye in the dye layer, the heat the dye layer attains, and the length of time for which the heat is maintained at any given spot on the donor layer.

U.S. Pat. No. 5,096,874 describes a thermal heat-transfer recording method having a dye-diffusion coefficient in the receiving layer of at least $8.3\times10^{-11}$ $cm^2s^{-1}$ ($5\times10^{-9}$ $cm^2$/min) at 120° C. The saturated transfer ratio of the dye from the dye layer of the heat transfer sheet to the receiving layer of the image-receiving sheet was 40% or more at 120° C. at a printing speed of 33.3 msec/line when the dye layer of the heat transfer sheet was 1 μm thick and the receiving layer of the image-receiving sheet was 6 μm thick. A reflective color density of approximately 1.0 was achieved. U.S. Pat. No. 5,096,874 discloses that the dye diffusion coefficient and the dye transfer ratio can be optimized at any energy level to obtain a high-density image.

U.S. Pat. No. 5,256,622, discloses the use of high viscosity polymers as binders in a dye-donor layer. U.S. Pat. No. 5,256,622 discloses that both ethyl cellulose ether and cellulose acetate proprionate (CAP) are equally adequate as dye-donor layer binders, as long as their intrinsic viscosity is at least 1.6. The print speeds exemplified are slow print speeds of 4 msec/line or greater.

In both of the above references, slow print speeds were used, that is, print speeds of 4 msec/line or greater. At such print speeds, a different dye transfer efficiency is needed than at high printing speeds to effect printing of high-density images.

High printing speeds are less than 4 msec/line, for example, 2 msec/line or less. At high printing speeds, the print head undergoes heat on/off cycles very rapidly. This generated heat must be driven through the dye-donor support assemblage very rapidly to effect the dye transfer from the donor to the receiver. Each layer in the donor can act as an insulator, slowing down the heat transfer through the layers of the donor to the receiver. Because of the short heat application time, any reduction in heat transfer efficiency results in a lower effective temperature in the donor layer during printing, which can result in a lower transferred dye density. It is known to overcome the low print density associated with shorter line times by increasing the print-head voltage, increasing the dye density in the dye-donor layer, or a combination thereof. Applying higher print head voltages can decrease the lifetime of the thermal print head, and requires a higher power supply, both of which increase cost. Increasing the dye density in the dye-donor layer increases costs, as well as increasing the chance of unwanted dye transfer, such as during storage of a dye-donor element.

There is a need in the art for a means of increasing print speed while maintaining or increasing print density, such as by increased dye transfer efficiency, and maintaining or reducing power to the print head.

SUMMARY OF THE INVENTION

A thermal print assembly comprising a donor having a dye-donor layer including at least one dye and having a first glass transition temperature, and a receiver having a dye-receiving layer having a second glass transition temperature, wherein the print assembly has a receiver/donor dye partition coefficient of at least 2.5 when the print assembly is heated above the higher of the first or second glass transition temperature for a time sufficient to achieve an equilibrium state of dye distribution between the dye-donor layer and dye-receiving layer, is described, as well as a method of printing with the assembly.

ADVANTAGES

The thermal print assembly described herein provides for increased dye density with a reduced printing power, or maintaining or increasing dye density at shorter line times used in fast printing.

DETAILED DESCRIPTION OF THE INVENTION

A thermal print assembly including a donor having a dye-donor layer including at least one dye and having a first glass transition temperature, and a receiver having a dye-receiving layer having a second glass transition temperature, wherein the print assembly has a receiver/donor dye partition coefficient of at least 2.5 when the print assembly is heated above the higher of the first or second glass transition temperature for a time sufficient to achieve an equilibrium state of dye distribution between the dye-donor layer and dye-receiving layer, is described, as well as a method of printing with the assembly at fast printing speeds of 2 msec/line or less.

Image density of a thermal print is related to the amount of dye transferred between a dye-donor layer of a dye-donor element and a dye-receiving layer of a receiving element. The amount of dye transferred between the dye-donor layer and the receiving layer can be described by the receiver/donor dye partition coefficient, also known as the solubility coefficient, which is a measure of the amount of dye transferred from the dye-donor layer to the receiving layer at a given print speed and temperature. As the receiver/donor dye partition coefficient increases, the amount of dye transferred increases, resulting in higher image densities. Higher partition coefficients can enable reducing print energies while maintaining a given image density, increasing an image density at the same print energy, or maintaining a given image density while increasing print speed.

The partition coefficient is a result of the interaction of the dye with the dye-donor layer, the interaction of the dye with the dye-receiving layer, and the interaction of the dye-donor layer with the dye-receiving layer.

As used herein, the receiver/donor dye partition coefficient, P, between the dye in the dye-donor layer of the donor element and the dye in the dye-receiving layer of the receiver element refers to the ratio of the concentration (in wt. %) of the dye in the dye-receiver layer, $C_R$, to the concentration (in wt. %) of the dye in the dye-donor layer, $c_D$, after the two layers are held in intimate contact at a temperature above the higher glass transition temperature of the dye-receiving layer or dye-donor layer for a time sufficient to achieve equilibrium in the distribution of dye between the dye-donor layer and the dye-receiving layer, for example, at 140° C. for ten minutes.

$$P=c_R/c_D \quad (1)$$

The receiver/donor dye partition coefficient describes the equilibrium thermodynamic partitioning of a dye between two polymer films. It is a fundamental quantity of the dye/donor-polymer and dye/receiver-polymer film combination that can be independently specified. It does not depend upon the film thickness, the method of producing the partitioning between the films, or the rate of diffusion of the dye, so long as the two films are in thermodynamic equilibrium.

Values of P greater than 1 are desirable, and higher values of P indicate greater dye transfer efficiency during thermal printing, as taught by Edward J. Ozimek in *IS&T's NIP*19: *International Conference on Digital Printing Technologies*, Volume 19, p. 371–374, The Society for Imaging Science and Technology, Sep. 28, 2003. The inventors herein have determined that a P value of 2.5 or greater, for example, a P value of 4 or greater, is particularly desirable for printing at speeds of 2 msec/line or less.

The dye-donor element can include a dye-donor layer on a support. The dye-donor layer can include one or more colored areas (patches) containing dyes suitable for thermal printing. As used herein, a "dye" can be one or more dye, pigment, colorant, or a combination thereof, and can optionally be in a binder or carrier as known to practitioners in the art. During thermal printing, at least a portion of one or more colored areas can be imagewise or patch transferred to the receiver element, forming a colored image on the receiver element. The dye-donor layer can include a laminate area (patch) having no dye. The laminate area can follow one or more colored areas. During thermal printing, the entire laminate area can be transferred to the receiver element. The dye-donor layer can include one or more colored areas and one or more laminate areas. For example, the dye-donor layer can include three color patches, for example, yellow, magenta, and cyan, and a clear laminate patch, for forming a full color image with a protective laminate layer on a receiver element.

Any dye transferable by heat can be used in the dye-donor layer of the dye-donor element. The dye can be selected by taking into consideration hue, lightfastness, and solubility of the dye in the dye donor layer binder and the dye image receiving layer binder. Examples of suitable dyes can include, but are not limited to, diarylmethane dyes; triarylmethane dyes; thiazole dyes, such as 5-arylisothiazole azo dyes; methine dyes such as merocyanine dyes, for example, aminopyrazolone merocyanine dyes; azomethine dyes such as indoaniline, acetophenoneazomethine, pyrazoloazomethine, imidazoleazomethine, imidazoazomethine, pyridoneazomethine, and tricyanopropene azomethine dyes; xanthene dyes; oxazine dyes; cyanomethylene dyes such as dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyraleazo, imidazoleazo, thiadiazoleazo, triazoleazo, and disazo dyes; arylidene dyes such as alpha-cyano arylidene pyrazolone and aminopyrazolone arylidene dyes; spiropyran dyes; indolinospiropyran dyes; fluoran dyes; rhodaminelactam dyes; naphthoquinone dyes, such as 2-carbamoyl-4-[N-(p-substituted aminoaryl)imino]-1,4-naphthaquinone; anthraquinone dyes; and quinophthalone dyes. Specific examples of dyes usable herein can include:

C.I. (color index) Disperse Yellow 51, 3, 54, 79, 60, 23, 7, and 141;
C.I. Disperse Blue 24, 56, 14, 301, 334, 165, 19, 72, 87, 287, 154, 26, and 354;
C.I. Disperse Red 135, 146, 59, 1, 73, 60, and 167;
C.I. Disperse Orange 149;
C.I. Disperse Violet 4, 13, 26, 36, 56, and 31;
C.I. Disperse Yellow 56, 14, 16, 29, 201 and 231;
C.I. Solvent Blue 70, 35, 63, 36, 50, 49, 111, 105, 97, and 11;
C.I. Solvent Red 135, 81, 18, 25, 19, 23, 24, 143, 146, and 182;
C.I. Solvent Violet 13;
C.I. Solvent Black 3;
C.I. Solvent Yellow 93; and
C.I. Solvent Green 3.

Further examples of sublimable or diffusible dyes that can be used include anthraquinone dyes, such as Sumikalon Violet RS® (product of Sumitomo Chemical Co., Ltd.), Dianix Fast Violet 3R-FS® (product of Mitsubishi Chemical Corporation.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Corporation) and Direct Brown M® and Direct Fast Black D® (products of Nippon Kayaku Co. Ltd.); acid dyes such as Kayanol Milling Cyanine 5R® (product of Nippon Kayaku Co. Ltd.); and basic dyes such as Sumicacryl Blue 6G® (product of Sumitomo Chemical Co., Ltd.), and Aizen Malachite Green® (product of Hodogaya Chemical Co., Ltd.); magenta dyes of the structures

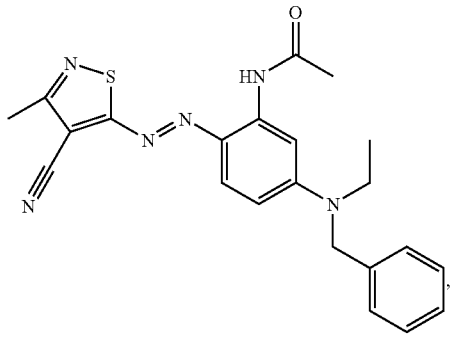

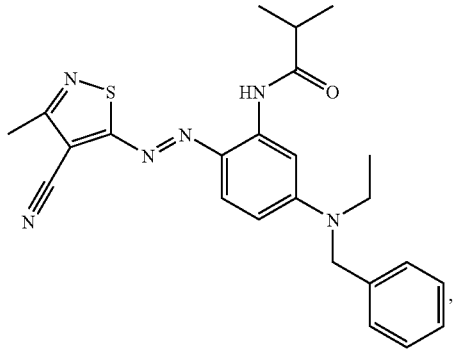

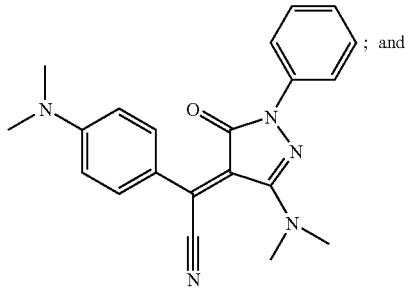

; and cyan dyes of the structures

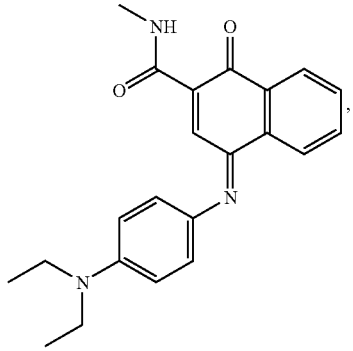

-continued

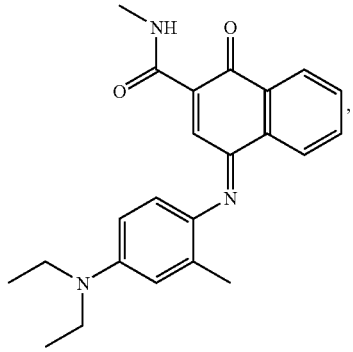

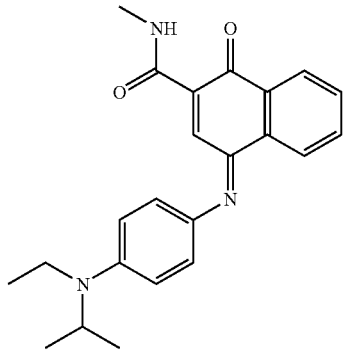

, and

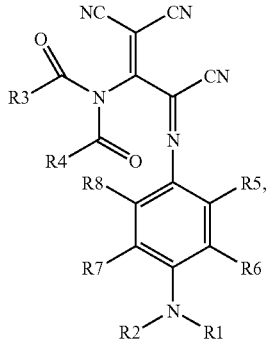

where R1 and R2 each independently represents an alkyl group, a cycloalkyl group, an aryl group, a heterocyclic group, or R1 and R2 together represent the necessary atoms to close a heterocyclic ring, or R1 and/or R2 together with R6 and/or R7 represent the necessary atoms to close a heterocyclic ring fused on the benzene ring; R3 and R4 each independently represents an alkyl group, or an alkoxy group; R5, R6, R7 and R8 each independently represents hydrogen, an alkyl group, a cycloalkyl group, an aryl group, an alkoxy group, an aryloxy group, a carbonamido group, a sulfamido group, hydroxy, halogen, $NHSO_2R_9$, $NHCOR_9$, $OSO_2R_9$, or $OCOR_9$, or R5 and R6 together and/or R7 and R8 together represent the necessary atoms to close one or more heterocyclic ring fused on the benzene ring, or R6 and/or R7 together with R1 and/or R2 represent the necessary atoms to close a heterocyclic ring fused on the benzene ring; and R9 represents an alkyl group, a cycloalkyl group, an aryl group and a heterocyclic group; and yellow dyes of the structures

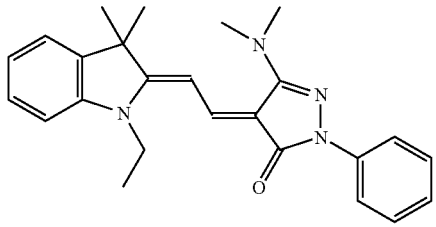

, and

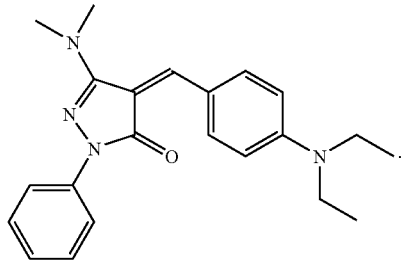

Further examples of useful dyes can be found in U.S. Pat. Nos. 4,541,830; 5,026,677; 5,101,035; 5,142,089; 5,804,531; and 6,265,345, and U.S. Patent Application Publication No. US 20030181331. Suitable cyan dyes can include Kayaset Blue 714 (Solvent Blue 63, manufactured by Nippon Kayaku Co., Ltd.), Phorone Brilliant Blue S-R (Disperse Blue 354, manufactured by Sandoz K. K.), and Waxoline AP-FW (Solvent Blue 36, manufactured by ICI). Suitable magenta dyes can include MS Red G (Disperse Red 60, manufactured by Mitsui Toatsu Chemicals, Inc.), and Macrolex Violet R (Disperse Violet 26, manufactured by Bayer). Suitable yellow dyes can include Phorone Brilliant Yellow S-6 GL (Disperse Yellow 231, manufactured by Sandoz K. K.) and Macrolex Yellow 6G (Disperse Yellow 201, manufactured by Bayer). The dyes can be employed singly or in combination to obtain a monochrome dye-donor layer or a black dye-donor layer. The dyes can be used in an amount of from 0.05 g/m$^2$ to 1 g/m$^2$ of coverage. According to various embodiments, the dyes can be hydrophobic.

Dyes suitable for use herein are chosen in combination with a binder in the dye-donor layer of the donor element and in combination with a polymer of the dye-receiving layer of the receiver element, such that the receiver/donor dye partition coefficient between the dye in the dye-donor layer of the donor element and the dye in the dye-receiving layer of the receiver element is 2.5 or greater.

Each dye-donor layer patch can range from 20 wt. % to 90 wt. % dye, relative to the total dry weight of all components in the layer. A high amount of dye is desirable for increased efficiency, but higher amounts of dye can lead to increased occurrences of donor/receiver sticking. Depending on the efficiency of the dye-donor layer, a lower amount of dye can be used to achieve the same efficiency as a different dye-donor layer. The dye percent is ideally chosen in view of the specific donor and receiver combination. Varying the amount of dye in the donor can aid in matching the efficiency between different dye patches, for example, a cyan, magenta, and yellow patch. For example, yellow and/or magenta patch dye amounts can be between 20 wt. % and 75 wt. % dye relative to the total dry weight of all components in the layer, for example, between 30 wt. % and 50 wt. %. A cyan patch dye amount can be between 40 wt. % and 90 wt. % dye relative to the total dry weight of all components in the layer, for example, between 55 wt. % and 75 wt. %.

To form a dye-donor layer, one or more dyes can be dispersed in a polymeric binder, for example, polycarbonate; poly(styrene-co-acrylonitrile); poly(sulfone); poly(phenylene oxide); polystyrene; phenoxy resin; acrylic resin such as poly(methyl acrylate), poly(methyl methacrylate), and poly(butyl methacrylate); poly(vinyl acetate); cellulose derivatives such as but not limited to cellulose acetate hydrogen phthalate, cellulose acetate, cellulose acetate propionate, cellulose acetate butyrate, or cellulose triacetate; a hydroxyalkyl cellulose, such as hydroxypropyl cellulose, methylhydroxypropyl cellulose, hydroxypropylmethyl cellulose; polyacetals; poly(vinyl butyral); poly(vinyl pental); polyvinylhexal; poly(vinyl heptal); ethyl cellulose; or a combination thereof. The binder can be used in an amount of from 0.05 g/m$^2$ to 5 g/m$^2$.

According to certain embodiments, the binder can include ethyl cellulose. The ethyl cellulose can have an ethoxyl content between 45 and 53%, preferably between 48 and 52%, and a solution viscosity of between 2 and 200 centipoise, for example, between 10 and 150 centipoise, as measured by a 5 wt. % solution in an 80/20 wt. % mixture of toluene and ethanol at 25° C. Mixtures of various ethyl cellulose grades can be used. For example, a mixture can include an ethyl cellulose with a high ethoxyl content (50.5% ethoxyl content or greater) with an ethyl cellulose with a low ethoxyl content (less than 50.5% ethoxyl content). By adjusting the mixture of ethyl celluloses with different ethoxyl contents, the shape of the sensitometric curve can be adjusted. Two or more ethyl celluloses can be mixed. The ratio of high ethoxyl content ethyl cellulose to low ethoxyl content ethyl cellulose can be from 2:98 to 98:2, for example, from 5:95 to 95:5, from 15:85 to 85:15, or from 25:75 to 75:25.

According to certain embodiments, the binder can include one or more polyvinylacetal copolymers. A suitable polyvinylacetal copolymer binder can have formula I:

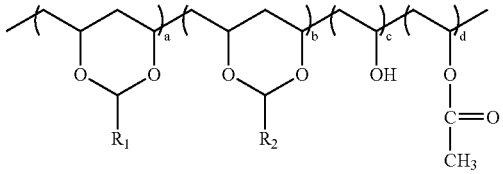

wherein each $R_1$ is an alkyl group of from 0 to 5 carbon atoms, wherein each alkyl group independently can be linear, branched, or cyclic; each $R_2$ is a linear, branched, or cyclic alkyl group of from 4 to 25 carbon atoms, or an aryl group of from 4 to 25 carbon atoms, wherein the aryl group is not unsubstituted phenyl;

a represents a mole % of from 0 to 98;

b represents a mole % of from 1 to 98;

c represents a mole % of from 0 to 12;

d represents a mole % of from 0 to 2; and the sum of a, b, c, and d equals 100.

Examples of suitable polyvinylacetal copolymers can include, but are not limited to, polyvinylpental, polyvinylhexal, poly(vinylbutyral-co-vinylhexal), poly(vinylbutyral-co-vinylheptal), poly(vinylbutyral-co-vinyloctal), and poly (vinylbutyral-co-vinylnaphthal).

The dye-donor layer of the dye-donor element can be formed or coated on a support. The dye-donor layer composition can be dissolved in a solvent for coating purposes. The dye-donor layer can be formed or coated on the support by techniques such as, but not limited to, a gravure process, spin-coating, solvent-coating, extrusion coating, or other methods known to practitioners in the art.

The support can be formed of any material capable of withstanding the heat of thermal printing. According to various embodiments, the support can be dimensionally stable during printing. Suitable materials can include polyesters, for example, poly(ethylene terephthalate) and poly (ethylene naphthalate); polyamides; polycarbonates; glassine paper; condenser paper; cellulose esters, for example, cellulose acetate; fluorine polymers, for example, polyvinylidene fluoride, and poly(tetrafluoroethylene-co-hexafluoropropylene); polyethers, for example, polyoxymethylene; polyacetals; polystyrenes; polyolefins, for example, polyethylene, polypropylene, and methylpentane polymers; polyimides, for example, polyimide-amides and polyether-imides; and combinations thereof. The support can have a thickness of from 1 μm to 30 μm, for example, from 3 μm to 7 μm.

According to various embodiments, a subbing layer, for example, an adhesive or tie layer, a dye-barrier layer, or a combination thereof, can be coated between the support and the dye-donor layer. The subbing layer can be one or more layers. The adhesive or tie layer can adhere the dye-donor layer to the support. Suitable adhesives are known to practitioners in the art, for example, Tyzor TBT® from E.I. DuPont de Nemours and Company. The dye-barrier layer can include a hydrophilic polymer. The dye-barrier layer can provide improved dye transfer densities.

The dye-donor element can include a slip layer to reduce or prevent print head sticking to the dye-donor element. The slip layer can be coated on a side of the support opposite the dye-donor layer. The slip layer can include a lubricating material, for example, a surface-active agent, a liquid lubricant, a solid lubricant, or mixtures thereof, with or without a polymeric binder. Suitable lubricating materials can include oils or semi-crystalline organic solids that melt below 100° C., for example, poly(vinyl stearate), beeswax, perfluorinated alkyl ester polyether, poly(caprolactone), carbowax, polyethylene homopolymer, or poly(ethylene glycol). The lubricating material can also be a silicone- or siloxane-containing polymer. Suitable polymers can include graft co-polymers, block polymers, co-polymers, and polymer blends or mixtures. Suitable polymeric binders for the slip layer can include poly(vinyl alcohol-co-vinylbutyral), poly(vinyl alcohol-co-vinylacetal), poly(styrene), poly(vinyl acetate), cellulose acetate butyrate, cellulose acetate, ethyl cellulose, and other binders as known to practitioners in the art. The amount of lubricating material used in the slip layer is dependent, at least in part, upon the type of lubricating material, but can be in the range of from 0.001 to 2 $g/m^2$, although less or more lubricating material can be used as needed. If a polymeric binder is used, the lubricating material can be present in a range of 0.1 to 50 weight %, preferably 0.5 to 40 weight %, of the polymeric binder.

The dye-donor element can include a stick preventative agent to reduce or eliminate sticking between the dye-donor element and the receiver element during printing. The stick preventative agent can be present in any layer of the dye-donor element, so long as the stick preventative agent is capable of diffusing through the layers of the dye-donor element to the dye-donor layer, or transferring from the slip layer to the dye-donor layer. For example, the stick preventative agent can be present in one or more patches of the dye-donor layer, in the support, in an adhesive layer, in a dye-barrier layer, in a slip layer, or in a combination thereof. According to various embodiments, the stick preventative agent can be in the slip layer, the dye-donor layer, or both. According to various embodiments, the stick preventative agent can be in the dye-donor layer. The stick preventative agent can be in one or more colored patches of the dye-donor layer, or a combination thereof. If more than one dye patch is present in the dye-donor layer, the stick preventative agent can be present in the last patch of the dye-donor layer to be printed, typically the cyan layer. However, the dye patches can be in any order. For example, if repeating patches of cyan, magenta, and yellow are used in the dye-donor element, in that respective order, the yellow patches, as the last patches printed in each series, can include the stick preventative agent. The stick preventative agent can be a silicone- or siloxane-containing polymer. Suitable polymers can include graft co-polymers, block polymers, co-polymers, and polymer blends or mixtures. Suitable stick preventative agents are described, for example, in commonly assigned U.S. applications Ser. No. 10/667,065 to David G. Foster, et al., and Ser. No. 10/729,567 to Teh-Ming Kung, et al.

Optionally, release agents as known to practitioners in the art can also be added to the dye-donor element, for example, to the dye-donor layer, the slip layer, or both. Suitable release agents can include, for example, those described in U.S. Pat. Nos. 4,740,496 and 5,763,358.

According to various embodiments, the dye-donor layer can contain no plasticizer. Inclusion of the plasticizer in the dye-donor layer can increase dye-donor efficiency. The dye-donor layer can include plasticizers known in the art, such as those described in U.S. Pat. Nos. 5,830,824 and 5,750,465, and references disclosed therein. Suitable plasticizers can include compounds having a glass transition temperature ($T_g$) less than 25° C., a melting point ($T_m$) less than 25° C., or both. Plasticizers useful for this invention can include low molecular weight plasticizers and higher molecular weight plasticizers such as oligomeric or polymeric plasticizers. Examples of suitable plasticizers can include aliphatic polyesters, epoxidized oils, chlorinated hydrocarbons, poly(ethylene glycols), poly(propylene glycols), and poly(vinyl ethyl ether) (PVEE). The molecular weight of the plasticizer can be greater than or equal to 450 to minimize transfer of the plasticizer to the dye receiving layer during printing. Transfer of some plasticizers to the dye receiving layer can result in image keeping and stability problems. The plasticizer can be present in an amount of from 1 to 50%, for example, from 5% to 35%, by weight of the binder.

Aliphatic polyesters suitable as plasticizers can be derived from succinic acid, glutaric acid, adipic acid, pimelic acid, suberic acid, azelaic acid, and sebacic acid. Suitable aliphatic polyesters can have one or more functional end groups, for example a carboxyl, hydroxyl, or alkoxyl group, where each alkoxyl group can be from 1 to 18 carbon atoms. Examples of suitable aliphatic polyesters can include Drapex plasticizers (Crompton/Witco Corporation, Middlebury, Conn., USA), such as Drapex 429, Admex plasticizers (Velsicol Chemical Corporation, Rosemont, Ill., USA) such as Admex 429, and Paraplex G25, Plasthall HA7A, Plasthall P650, Plasthall P-7092, all from CP Hall Company, Chicago, Ill., USA.

Epoxidized oils suitable as plasticizers can include partially or completely epoxidized natural oils, and partially or completely epoxidized derivatized natural oils such as epoxidized soybean oil sold as Paraplex G-60, Paraplex G-62, and Plasthall ESO; epoxidized linseed oil sold as Plasthall ELO; or epoxidized octyl tallate sold as Plasthall S-73, all from C. P. Hall Company.

Chlorinated hydrocarbons suitable for use as plasticizers can include long-chain hydrocarbons or paraffins consisting of methylene, methyl, methane, or alkene groups, any of which can have a chlorine substitution. The length of the long-chain hydrocarbon can be between 8 and 30 carbon atoms, for example, between 12 and 24 carbon atoms. The chains can be branched. The amount of chlorine in the paraffin can be between 25 and 75 wt. %, for example, between 40 and 70 wt. %. Mixtures of chlorinated paraffins can also be used. According to certain embodiments, the chlorinated paraffins can have the formula $C_xH_yCl_z$ wherein x is between 11 and 24, y is between 14 and 43, and z is between 3 and 10. Examples of suitable chlorinated hydrocarbons can include Chlorowax liquids sold by Occidental Chemical Corp., Dallas, Tex., USA, and Paroil paraffins sold by Dover Chemical Corp., Dover, Ohio, USA, such as Chlorowax 40 and Paroil 170HV.

Poly(ethylene glycols) and poly(propylene glycols) suitable for use as plasticizers can have unsubstituted end groups (OH), or they can be substituted with one or more functional groups such as an alkoxyl group or fatty acid, where each alkoxyl group or fatty acid can be from 1 to 18 carbon atoms. Examples of suitable poly(ethylene glycols) and poly(propylene glycols) can include TegMer 809 poly (ethylene glycol) from C. P. Hall Co., and PPG #483 poly(propylene glycol) from Scientific Polymer Products, Ontario, N.Y., USA.

The dye-donor layer can include beads. The beads can have a particle size of from 0.5 to 20 microns, preferably from 2.0 to 15 microns. The beads can act as spacer beads under the compression force of a wound up dye-donor roll, improving raw stock keeping of the dye-donor roll by reducing the material transferred from the dye-donor layer to the slipping layer, as measured by the change in sensitometry under accelerated aging conditions, or the appearance of unwanted dye in the laminate layer, or from the backside of the dye-donor element, for example, a slipping layer, to the dye-donor layer. The use of the beads can result in reduced mottle and improved image quality. The beads can be employed in any amount effective for the intended purpose. In general, good results have been obtained at a coverage of from 0.003 to 0.20 g/m$^2$. Beads suitable for the dye-donor layer can also be used in the slip layer.

The beads in the dye-donor layer can be crosslinked, elastomeric beads. The beads can have a glass transition temperature (Tg) of 45° C. or less, for example, 10° C. or less. The elastomeric beads can be made from an acrylic polymer or copolymer, such as butyl-, ethyl-, propyl-, hexyl-, 2-ethyl hexyl-, 2-chloroethyl-, 4-chlorobutyl- or 2-ethoxyethyl-acrylate or methacrylate; acrylic acid; methacrylic acid; hydroxyethyl acrylate; a styrenic copolymer, such as styrene-butadiene, styrene-acrylonitrile-butadiene, styrene-isoprene, or hydrogenated styrene-butadiene; or mixtures thereof. The elastomeric beads can be crosslinked with various crosslinking agents, which can be part of the elastomeric copolymer, such as but not limited to divinylbenzene; ethylene glycol diacrylate; 1,4-cyclohexylene-bis (oxyethyl)dimethacrylate; 1,4-cyclohexylene-bis(oxypropyl)diacrylate; 1,4-cyclohexylene-bis(oxypropyl) dimethacrylate; and ethylene glycol dimethacrylate. The elastomeric beads can have from 1 to 40%, for example, from 5 to 40%, by weight of a crosslinking agent.

The beads in the dye-donor layer can be hard polymeric beads. Suitable beads can include divinylbenzene beads, beads of polystyrene crosslinked with at least 20 wt. % divinylbenzene, and beads of poly(methyl methacrylate) crosslinked with at least 20 wt. % divinylbenzene, ethylene glycol dimethacrylate, 1,4-cyclohexylene-bis(oxyethyl) dimethacrylate, 1,4-cyclohexylene-bis(oxypropyl) dimethacrylate, or other crosslinking monomers known to those familiar with the art.

The dye-donor element can be a sheet of one or more colored patches or laminate, or a continuous roll or ribbon. The continuous roll or ribbon can include one patch of a monochromatic color or laminate, or can have alternating areas of different patches, for example, one or more dye patches of cyan, magenta, yellow, or black, one or more laminate patches, or a combination thereof.

The receiver element suitable for use with the dye-donor element described herein can be any receiver element as known to practitioners in the art. For example, the receiver element can include a support having thereon a dye image-receiving layer. The support can be a transparent film. Transparent supports include cellulose derivatives, for example, a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; poly(vinyl alcohol-co-vinyl acetal); polyolefins, such as polyethylene or polypropylene; polysulfones; polyacrylates; polyetherimides; and mixtures thereof. Opaque supports can include plain paper, coated paper, synthetic paper, photographic paper support, melt-extrusion-coated paper, and laminated paper, such as biaxially oriented support laminates. Biaxially oriented support laminates suitable for use as receivers are described in U.S. Pat. Nos. 5,853,965; 5,866,282; 5,874,205; 5,888,643; 5,888,681; 5,888,683; and 5,888,714. Biaxially oriented supports can include a paper base and a biaxially oriented polyolefin sheet, for example, polypropylene, laminated to one or both sides of a paper base. The support can be a reflective paper, for example, baryta-coated paper, white polyester (polyester with white pigment incorporated therein), an ivory paper, a condenser paper, or a synthetic paper, for example, DuPont Tyvek® by E.I. DuPont de Nemours and Company, Wilmington, Del. The support can be employed at any desired thickness, for example, from 10 μm to 1000 μm. Exemplary supports for the dye image-receiving layer are disclosed in commonly assigned U.S. Pat. Nos. 5,244,861 and 5,928,990, and in EP-A-0671281. Other suitable supports as known to practitioners in the art can also be used. According to various embodiments, the support can be a composite or laminate structure comprising a base layer and one or more additional layers. The base layer can comprise more than one material, for example, a combination of one or more of a microvoided layer, a nonvoided layer, a synthetic paper, a natural paper, and a polymer.

The dye image-receiving layer of the receiver element can be, for example, a polycarbonate, a polyurethane, a polyester, polyvinyl chloride, poly(styrene-co-acrylonitrile), poly (caprolactone), poly(vinyl butyral), polyvinylacetals such as polyvinylheptal, poly(vinyl chloride-co-vinyl acetate), poly (ethylene-co-vinyl acetate), methacrylates including those described in U.S. Pat. No. 6,362,131, or combinations thereof. The dye image-receiving layer can be coated on the receiver element support in any amount effective for the intended purpose of receiving the dye from the dye-donor layer of the dye-donor element. For example, the dye image-receiving layer can be coated in an amount of from 1 g/m$^2$ to 5 g/m$^2$.

Additional polymeric layers can be present between the support and the dye image-receiving layer. The additional layers can provide coloring, adhesion, antistat properties, act as a dye-barrier, act as a dye mordant layer, or a combination thereof. For example, a polyolefin such as polyethylene or polypropylene can be present. White pigments such as titanium dioxide, zinc oxide, and the like can be added to the polymeric layer to provide reflectivity. A subbing layer optionally can be used over the polymeric layer in order to improve adhesion to the dye image-receiving layer. This can be called an adhesive or tie layer. Exemplary subbing layers are disclosed in U.S. Pat. Nos. 4,748,150, 4,965,238, 4,965,239, and 4,965,241. An antistatic layer as known to practitioners in the art can also be used in the receiver element. The receiver element can also include a backing layer. Suitable examples of backing layers include those disclosed in U.S. Pat. Nos. 5,011,814 and 5,096,875.

The dye image-receiving layer, or an overcoat layer thereon, can contain a release agent, for example, a silicone or fluorine based compound, as is conventional in the art. Various exemplary release agents are disclosed, for example, in U.S. Pat. Nos. 4,820,687 and 4,695,286.

The receiver element can also include stick preventative agents, as described for the donor element. According to various embodiments, the receiver element and dye-donor element can include the same stick preventative agent.

The dye image-receiving layer can be formed on the support by any method known to practitioners in the art, including but not limited to printing, solution coating, dip coating, and extrusion coating. Wherein the dye image-receiving layer is extruded, the process can include (a) forming a melt comprising a thermoplastic material; (b) extruding or coextruding the melt as a single-layer film or a layer of a composite (multilayer or laminate) film; and (c) applying the extruded film to the support for the receiver element.

The dye-donor element and receiver element, when placed in superimposed relationship such that the dye-donor layer of the dye-donor element is adjacent the dye image-receiving layer of the receiver element, can form a print assembly. An image can be formed by passing the print assembly past a print head, wherein the print head is located on the side of the dye-donor element opposite the receiver element. The print head can apply heat image-wise or patchwise to the dye-donor element, causing the dyes or laminate in the dye-donor layer to transfer to the dye image-receiving layer of the receiver element.

Thermal print heads that can be used with the print assembly are available commercially and known to practitioners in the art. Exemplary thermal print heads can include, but are not limited to, a Fujitsu Thermal Head (FTP-040 MCSOO1), a TDK Thermal Head F415 HH7-1089, a Rohm Thermal Head KE 2008-F3, a Shinko head (TH300U162P-001), and Toshiba heads (TPH162R1 and TPH207R1A).

Use of the print assembly as described herein provides a receiver/donor dye partition coefficient of 2.5 or greater, for example, 3.0 or greater, or 4.0 or greater, when the print assembly is heated above the higher of the glass transition temperature of the dye-donor layer or the dye-receiving layer for a time sufficient to achieve an equilibrium state of dye distribution between the dye-donor layer and dye-receiving layer, thereby improving dye density of the printed image, reducing power needed for printing, allowing for fast printing, or a combination thereof. Fast printing or high-speed printing refers to printing at a line speed of 2.0 msec/line or less, for example, 1.5 msec/line or less, 1.2 msec/line or less, 1.0 msec/line or less, or 0.5 msec/line or less. The print assembly can produce a defect-free image with a resultant print density greater than or equal to 2.0. Examples are herein provided to further illustrate the invention.

EXAMPLES

Materials used in the examples include the following:

Polymers set forth in Tables 1–4 were obtained from the following sources. EC-461 is ethyl cellulose with a 49% ethoxyl content purchased from Scientific Polymer Products located in Ontario, N.Y., USA. Ethocel 45 and Ethocel 100 are standard industrial grade ethyl cellulose, with 48.0–49.5% ethoxyl content, obtained from Dow Chemical Company, Midland, Mich. Hercules Aqualon ethyl cellulose polymers were all obtained from Hercules Chemical, Wilmington, Del., and had the following ethoxyl contents:

Aqualon K50—45.0–47.2% ethoxyl content,

Aqualon N50 and Aqualon N22—48.0–49.5% ethoxyl content,

Aqualon T50—49.6–51.5% ethoxyl content, and

Aqualon X22—50.5–52.5% ethoxyl content.

The following cellulose ester polymers were obtained from Eastman Chemical Company, Kingsport, Tenn.: CAP-482-20 cellulose acetate propionate with 2.5% acetyl, 46.0% propionyl, and 1.8% hydroxyl; CAB-500-5 cellulose acetate butyrate with 4% acetyl, 51% butyryl, and 1.0% hydroxyl; and CAB-381-20 cellulose acetate butyrate with 13.5% acetyl, 37% butyryl, and 1.8% hydroxyl. Butvar B76 and Butvar B79 are polyvinyl butyral polymers manufactured by Solutia Incorporated, St. Louis, Mo., with 88% butyral, 1% acetate, and 11% hydroxyl. Phenoxy resin (cat. No. 045A) and poly(methyl methacrylate) (PMMA) (cat. No. 037B) were obtained from Scientific Polymer Products, Ontario, N.Y. Polyvinylacetal was obtained as polymer S-LEC K KS-1 manufactured by Sekisui Chemical Co., Ltd., Osaka, Japan.

Poly(vinylhexal-co-vinyl alcohol-co-vinyl acetate), hereinafter referred to as polyvinylhexal was prepared as follows. A 3-liter, 3-necked round-bottomed flask was fitted with a mechanical stirrer, reflux condenser, and inert gas inlet tube. Absolute ethanol (1100 mL) was added to the flask followed by 120 g of poly(vinyl alcohol) (1.362 mol), obtained as Gohsenol NH-18, 98–99% hydrolyzed, viscosity 25–30, from Nippon Gohsei Company, Osaka, Japan. This mixture was stirred overnight at room temperature. The stirred mixture was heated in a water bath at 75° C., and 1.63 mL of concentrated sulfuric acid was added to the flask with stirring. A solution of 179.9 mL of hexaldehyde (1.498 mol; 1.1 equivalents) in 550 mL of dioxane was added to the reaction mixture with stirring over 75 minutes. The mixture was stirred at 75° C. for 28 hours, and then cooled to room temperature. The resultant polymer solution was clear and slightly yellow. It was precipitated into 8×3500 mL of water in a blender, and filtered. The collected white precipitate was washed well with fresh water. The precipitated polymer was stirred in a pH 11 aqueous NaOH solution for several hours, filtered, washed until the filtrate was neutral, and dried in vacuo. The polymer was then dissolved in tetrahydrofuran to make a 15 wt. % solution, re-precipitated in a large excess of water, washed, and dried. The glass transition temperature of the resultant polymer was 37.5° C.

Polymer PC-1 is a polycarbonate of 50-mol % bisphenol-A and 50-mol % diethylene glycol and was prepared according to the procedure described in U.S. Pat. No. 5,266,551.

Polymer Blend-1 is a blend of 19% Lexan 151 Polycarbonate (GE Plastics, Pittsfield, Mass.) and 81% of a polyester. The polyester was synthesized according to the procedure described in U.S. Pat. No. 5,387,571, and was derived from 1,4-cyclohexanedicarboxylic acid, and diols comprising 49-mol % 1,4-cyclohexanedimethanol, 49-mol % 4,4'-bis(2-hydroxyethyl)bisphenol-A, and 2-mol % 1,1,1-trimethylolpropane.

Example 1

Print Assembly I-1P includes a dye-receiving layer and a dye-donor layer. The dye-receiving layer was made of CAP-482-20 prepared by dissolving 5.04 gm of CAP-482-20 in 74.96 gm of dichloromethane, coating the solution onto a 100-micron thick Estar® polyester support at a dry thickness coverage of 5 microns, and drying at room temperature. The dye-donor layer was made by dissolving 5.04 gm of polymer PC-1 in 74.96 gm of dichloromethane, adding 0.24 gm of the dye Magenta #1, whose structure is given below, coating the solution onto the dried dye-receiving layer at a dry thickness coverage of 5 microns, drying overnight at room temperature, and then drying at 60° C. for several hours.

Magenta dye #1

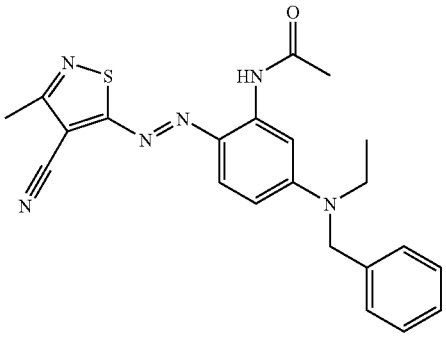

The dye was partitioned between the dye-donor layer and the dye-receiving layer by placing the print assembly between two heated platens and holding the assembly at 140° C. under a pressure of 0.35 to 0.70 MPa for 10 minutes. The print assembly was removed from between the heated platens and allowed to cool to room temperature before determining the receiver/donor dye partition coefficient, P, by peeling apart the dye-receiving layer and dye-donor layer at room temperature, and dissolving 1.5 to 1.7 mg of each of the two layers separately in dichloromethane. The dye concentration of each solution was then measured using a Perkin-Elmer Lambda 2 UV-visible spectrophotometer using standard analytical methods.

The concentration of dye in each dry polymer layer was calculated from the measured dissolved dye concentration and the dry weight of each sample prior to dissolution. The receiver/donor dye partition coefficient was then calculated as the ratio of the dye concentration in the dye-receiving layer to the dye concentration in the dye-donor layer, according to Equation (1).

Subsequent print assemblies listed in Table 1 and Table 2 were prepared and measured in the same way as described above for Print Assembly I-1P, except that cyan dye #1, magenta dye #3, or yellow dye #1 as shown below were substituted for magenta dye #1, and the polymer compositions of the dye-donor layer and the dye-receiving layer were changed as shown in Table 1 and Table 2. The results are shown in Table 1.

cyan dye #1

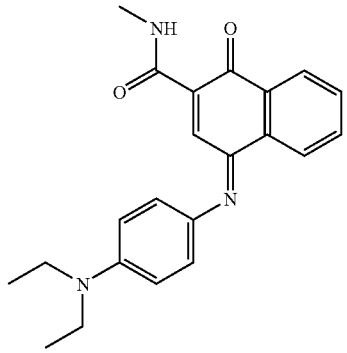

magenta dye #3

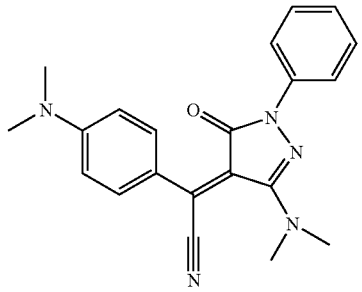

yellow dye #1

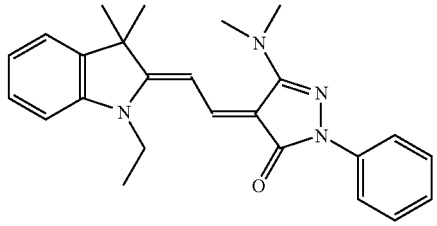

As shown in Table 1 below, the inventive examples I-1P through I-10P all have receiver/donor dye partition coefficients P greater than 2.5, and all but one exceed 4.5 in value. Comparative examples C-1P through C-23P have receiver/donor dye partition coefficient P values of less than 2.5, and typically less than 2.0.

TABLE 1

| | Receiver | Donor | | |
|---|---|---|---|---|
| Example | Polymer | Polymer | Dye | P |
| I-1P | PC-1 | Ethocel 45 | Magenta #1 | 4.75 |
| I-2P | PC-1 | Ethocel 45 | Magenta #3 | 8.08 |
| I-3P | PC-1 | Ethocel 45 | Yellow #1 | 4.81 |
| I-4P | PC-1 | Ethocel 45 | Cyan #1 | 4.9 |
| I-5P | Blend-1 | Ethocel 45 | Magenta #1 | 5.64 |
| I-6P | Blend-1 | Ethocel 45 | Magenta #3 | 7.67 |
| I-7P | Blend-1 | Ethocel 45 | Yellow #1 | 5.43 |
| I-8P | Blend-1 | Ethocel 45 | Cyan #1 | 5.57 |
| I-9P | Butvar B76 | Ethocel 45 | Cyan #1 | 4.57 |
| I-10P | Polyvinylhexal | Ethocel 45 | Cyan #1 | 2.76 |
| C-1P | CAP 482-20 | Ethocel 45 | Magenta #1 | 1.58 |
| C-2P | CAP 482-20 | Ethocel 45 | Magenta #3 | 2.43 |
| C-3P | CAP 482-20 | Ethocel 45 | Yellow #1 | 2.06 |
| C-4P | CAP 482-20 | Ethocel 45 | Cyan #1 | 1.5 |
| C-5P | PC-1 | CAP 482-20 | Magenta #1 | 1.62 |
| C-6P | PC-1 | CAP 482-20 | Magenta #3 | 1.81 |
| C-7P | PC-1 | CAP 482-20 | Yellow #1 | 1.42 |
| C-8P | PC-1 | CAP 482-20 | Cyan #1 | 2.2 |
| C-9P | Blend-1 | CAP 482-20 | Magenta #1 | 2.14 |

TABLE 1-continued

| Example | Receiver Polymer | Donor Polymer | Dye | P |
|---|---|---|---|---|
| C-10P | Blend-1 | CAP 482-20 | Magenta #3 | 2.16 |
| C-11P | Blend-1 | CAP 482-20 | Yellow #1 | 1.74 |
| C-12P | Blend-1 | CAP 482-20 | Cyan #1 | 2 |
| C-13P | Butvar B76 | CAP 482-20 | Magenta #1 | 1.25 |
| C-14P | Butvar B76 | CAP 482-20 | Magenta #3 | 1.37 |
| C-15P | Butvar B76 | CAP 482-20 | Yellow #1 | 1.63 |
| C-16P | Butvar B79 | CAP 482-20 | Cyan #1 | 1.6 |
| C-17P | Polyvinylhexal | CAP 482-20 | Magenta #1 | 1.14 |
| C-18P | Polyvinylhexal | CAP 482-20 | Magenta #3 | 1.14 |
| C-19P | Polyvinylhexal | CAP 482-20 | Yellow #1 | 1.81 |
| C-20P | Polyvinylacetal | CAP 482-20 | Cyan #1 | 2.1 |
| C-21P | Phenoxy Resin | CAP 482-20 | Cyan #1 | 1.8 |
| C-22P | PMMA | CAP 482-20 | Cyan #1 | 1.0 |
| C-23P | CAP 482-20 | CAP 482-20 | Cyan #1 | 1.0 |

Additional examples of print assemblies and their receiver/donor dye partition coefficient P results are given in Table 2 below. The additional dye examples listed in Table 2 were synthesized according to the methods disclosed in U.S. Pat. Nos. 5,026,677 and 5,142,089. Structures for the tricyanopropene azomethine dyes used in the examples in Table 2 are given below.

Cyan Dye No. 4

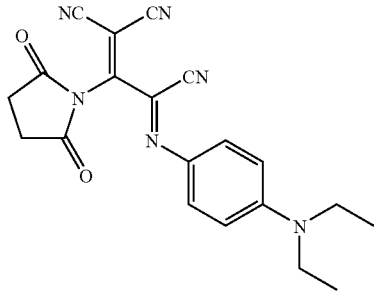

Cyan Dye No. 5

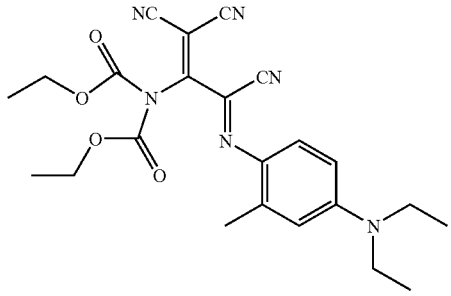

Cyan Dye No. 6

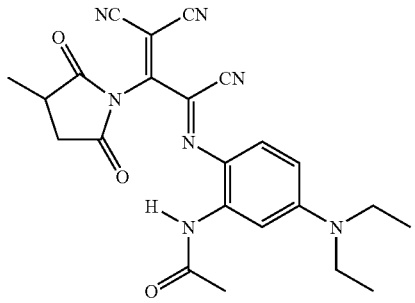

-continued

Cyan Dye No. 7

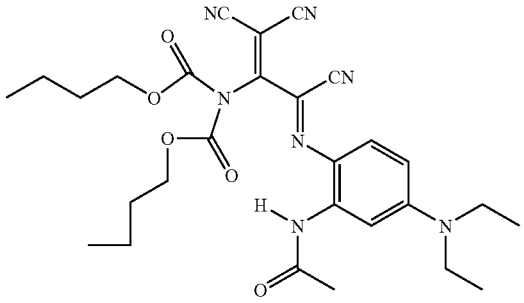

As can be seen in Table 2, inventive examples I-11P through I-19P all have P values exceeding 2.8. Comparative examples C-24P through C-37P all have P values of less than 2.2.

TABLE 2

| Example | Receiver Polymer | Donor Polymer | Dye | P |
|---|---|---|---|---|
| I-11P | PC-1 | Butvar B76 | Cyan Dye #4 | 5.89 |
| I-13P | PC-1 | Butvar B76 | Cyan Dye #5 | 2.85 |
| I-14P | PC-1 | Butvar B76 | Cyan Dye #6 | 4.74 |
| I-12P | PC-1 | Poly (vinylhexal) | Cyan Dye #4 | 11.31 |
| I-16P | PC-1 | Poly (vinylhexal) | Cyan Dye #5 | 4.78 |
| I-17P | PC-1 | Poly (vinylhexal) | Cyan Dye #6 | 10.96 |
| I-18P | PC-1 | Poly (vinylhexal) | Cyan Dye #7 | 3.35 |
| I-19P | Blend-1 | Poly (vinylhexal) | Cyan Dye #5 | 3.48 |
| I-15P | Blend-1 | Butvar B76 | Cyan Dye #6 | 3.22 |
| C-24P | PC-1 | CAP 482-20 | Cyan Dye #5 | 1.47 |
| C-25P | PC-1 | CAP 482-20 | Cyan Dye #6 | 1.5 |
| C-26P | PC-1 | CAP 482-20 | Cyan Dye #7 | 1.33 |
| C-27P | Blend-1 | CAP 482-20 | Cyan Dye #5 | 1 |
| C-28P | Blend-1 | CAP 482-20 | Cyan Dye #6 | 1.11 |
| C-29P | Blend-1 | CAP 482-20 | Cyan Dye #7 | 1.18 |
| C-30P | Butvar B76 | CAP 482-20 | Cyan Dye #5 | 0.69 |
| C-31P | Butvar B76 | CAP 482-20 | Cyan Dye #6 | 0.44 |
| C-32P | Butvar B76 | CAP 482-20 | Cyan Dye #7 | 0.8 |
| C-33P | Poly (vinylhexal) | CAP 482-20 | Cyan Dye #5 | 0.46 |
| C-34P | Poly (vinylhexal) | CAP 482-20 | Cyan Dye #6 | 0.24 |
| C-35P | Poly (vinylhexal) | CAP 482-20 | Cyan Dye #7 | 0.68 |
| C-36P | PC-1 | Butvar B76 | Cyan Dye #7 | 2.17 |
| C-37P | Blend-1 | Butvar B76 | Cyan Dye #7 | 1.79 |

Tables 1 and 2 above demonstrate that selection of the dye, the dye-donor layer, and the dye-receiving layer in a print assembly can result in a receiver/donor dye partition coefficient with a value of 2.5 or greater.

The following printing examples demonstrate that providing a print assembly having a partition coefficient of 2.5 or greater as defined herein, enables fast printing while maintaining or increasing print density and maintaining or reducing power to the print head.

Example 2

Dye-donor Element I-1

A dye-donor element was prepared by coating the following layers in the order recited on a first side of a 4.5 micron poly(ethylene terephthalate) support:

(1) a subbing layer of a titanium alkoxide (Tyzor TBT® from E.I DuPont de Nemours and Company) (0.16 g/m$^2$) from n-propyl acetate and n-butyl alcohol solvent mixture, and (2) a dye-donor layer containing the cyan dyes illustrated below in the following amounts: cyan dye #1 at 0.093 g/m$^2$, cyan dye #2 at 0.084 g/m$^2$, and cyan dye #3 at 0.21 g/m$^2$; ethyl cellulose (EC-461, Scientific Polymer Products, Inc.) binder at 0.22 g/m$^2$; and divinyl benzene beads at 0.0084 g/m$^2$ coated from a solvent mixture of 75 wt. % toluene, 20 wt. % methanol, and 5 wt. % cyclopentanone.

cyan dye #1

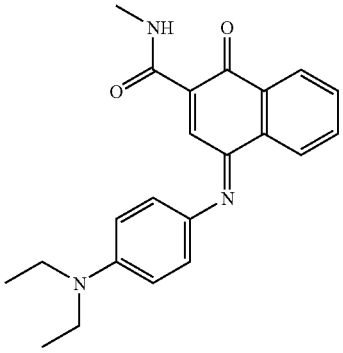

cyan dye #2

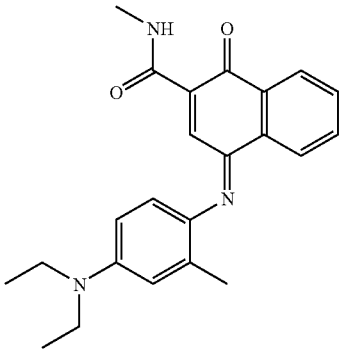

cyan dye #3

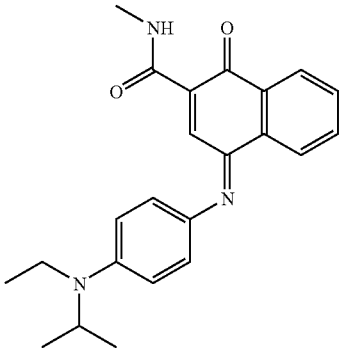

Dye donor element I-1 contains, in addition to the cyan dye #1 found in Table 1, two additional cyan dyes having similar structures and solubilities.

On a second side of the support, a slipping layer was prepared by coating the following layers in the order recited:

(1) a subbing layer of a titanium alkoxide (Tyzor TBT®) (0.16 g/m2) from n-propyl acetate and n-butyl alcohol solvent mixture, and (2) a slipping layer containing an ethene polymer of Polywax 400® (0.02 g/m$^2$), a polyalphaolefin of Vybar 103® (0.02 g/m$^2$), and a maleic anhydride copolymer of Ceremer 1608 (0.02 g/m$^2$), all from Baker-Petrolite Polymers, Sugar Land, Tex., and a polyvinylacetal binder (0.41 g/m$^2$) (Sekisui KS-1) coated from a solvent mixture of 75 wt. % toluene, 20 wt. % methanol, and 5 wt. % cyclopentanone.

Receiver R-1

Receiver R-1 of the composition shown below was prepared, having an overall thickness of about 220 μm and a thermal dye receiver layer thickness of about 3 μm. R-1 was prepared by solvent coating the subbing layer and dye receiving layer onto the prepared paper support.

| R-1 |
|---|
| 4–8 μm divinyl benzene beads and solvent coated cross-linked polyol dye receiving layer containing polymer PC-1 |
| Subbing layer |
| Microvoided composite film OPPalyte 350 K18 (ExxonMobil) |
| Pigmented polyethylene |
| Cellulose Paper |
| Polyethylene |
| Polypropylene film |

Dye-donor Elements I-2 Through I-8 and Comparative Elements C-1 Through C-4

Dye-donor elements I-2 through 1-8 and dye-donor comparative elements C-1 through C-4 were prepared the same as dye-donor element I-1, except that the ethyl cellulose (EC-461) in the dye-donor layer was replaced by the polymers listed in Table 3.

Printing Procedure

An 11-step patch image of optical density (OD) ranging from $D_{min}$ (OD<0.2) to $D_{max}$ (OD>2.0) was printed for donor-receiver sensitometry and sticking performance evaluation. When printed using 0.52 msec/line and a resistive head voltage of 25.4 V, this is equivalent to equal energy increments ranging from a print energy of 0 Joules/cm$^2$ to a print energy of 0.653 Joules/cm$^2$. When printed using 0.52 msec/line and a resistive head voltage of 32 V, this is equivalent to equal energy increments ranging from a print energy of 0 Joules/cm$^2$ to a print energy of 1.037 Joules/cm$^2$. Printing was done manually as described below.

The dye side of the dye-donor element was placed in contact with the dye image-receiving layer of the receiver element of the same width to form a print assembly. The print assembly was fastened to a stepper motor driven pulling device. The imaging electronics were activated, causing the pulling device to draw the print assembly between the print head and a roller at a rate of about 163 mm/sec. The printing line time was 0.52 msec/line. The voltage supplied to the resistive print head was constant for a given print. Two prints were made, one at 25.4 volts and one at 32 volts, corresponding to maximum print energies of 0.653 and 1.037 J/cm$^2$, respectively. The maximum print head voltage that could be applied without damaging the print head was 32 V. After each print, the dye-donor element and receiver element were separated manually and the Status A red reflection density of each printed step of the 11-step patch image on the receiver was measured using an X-Rite Transmission/Reflection Densitometer (model 820; X-Rite Incorporated). The values of the red density at the two different print energies of 0.653 and 1.037 J/cm$^2$ obtained when printing each dye-donor element to receiver R-1 are reported in Table 3.

TABLE 3

| Element | Polymer | Density at 0.653 J/cm$^2$ | Density at 1.037 J/cm$^2$ |
|---|---|---|---|
| I-1 | EC-461 | 1.11 | 2.17 |
| I-2 | Ethocel 100 | 1.03 | 2.10 |
| I-3 | Ethocel 45 | 1.04 | 2.12 |
| I-4 | Aqualon K50 | 0.92 | 2.06 |
| I-5 | Aqualon N50 | 1.0 | 2.13 |
| I-6 | Aqualon N22 | 0.97 | 2.13 |
| I-7 | Aqualon T50 | 0.99 | 2.18 |
| I-8 | Aqualon X22 | 1.14 | 2.11 |
| C-1 | CAP 482-20 | 0.82 | 1.94 |
| C-2 | Cellulose acetate butyrate (CAB381-20) | 0.88 | 1.96 |
| C-3 | Cellulose acetate butyrate (CAB500-5) | 1.01 | 1.99 |
| C-4 | polyvinylbutyral (Butvar B76) | 0.90 | 1.89 |

The above results show that when ethyl cellulose is used as the binder in the cyan dye-donor layer, higher optical print densities can be obtained for the same input energy than what can be obtained when other polymers are used as the binder in the dye-donor layer, particularly at higher print energies. The exception was C-3, which performed as well as some of the inventive elements at lower energy, but which did not produce densities nearly as high as the inventive elements at the higher energies which are needed to achieve high print densities at faster print times. The increased densities achieved by I1-I8 can be a critical advantage when printing at faster speeds.

The inventive elements I-1 through I-8 in Table 3 correspond in polymer layer composition to inventive example I-4P in Table 1, and show that the high cyan dye partition coefficient for ethyl cellulose dye-donor polymer in combination with the corresponding dye-receiver binder polymer, a P value of 4.9, produces high print densities at faster print times.

In contrast, comparative element C-1 in Table 3 corresponds in polymer layer composition to comparative example C-8P in Table 1, and demonstrates that the lower cyan dye partition coefficients for CAP-482-20, a P values of 2.2, produces lower print densities than the inventive elements at faster print times.

Example 3

Dye-donor Element I-9

A dye-donor element was prepared the same as dye-donor element I-1 except that the dye-donor layer contained the magenta dyes illustrated below as follows: Magenta dye #1 at 0.0700 g/m$^2$, Magenta dye #2 at 0.0642 g/m$^2$, and Magenta dye #3 at 0.1462 g/m$^2$, ethyl cellulose (Ethocel 45, Dow Chemical Company) binder at 0.2967 g/m$^2$, and 2 micron divinyl benzene beads at 0.0054 g/m$^2$ coated from a solvent mixture of 75 wt. % toluene, 20 wt. % methanol and 5 wt. % cyclopentanone.

Dye donor element I-9 contains, in addition to the magenta dyes #1 and #3 found in Table 1, one additional magenta dye having similar structure and solubility.

Magenta dye #1

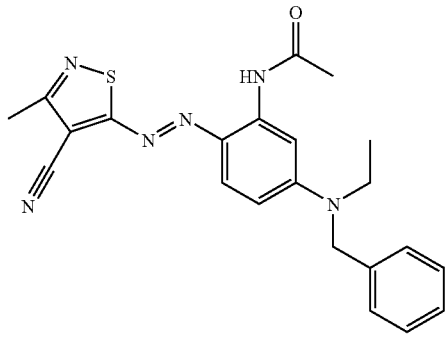

Magenta dye #2

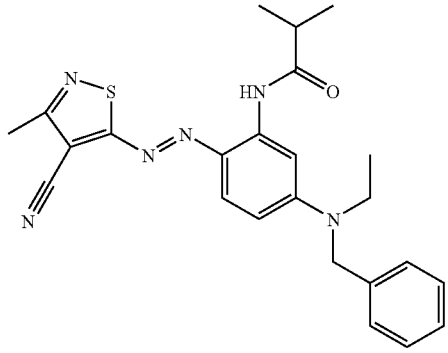

Magenta dye #3

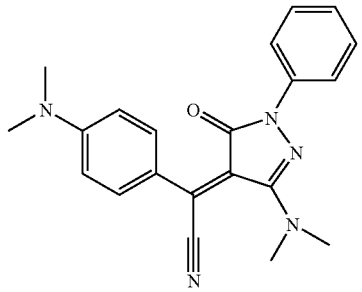

Dye-donor Elements I-10 Through I-13 and Comparative Element C-5

Dye-donor elements I-10 through I-13 and comparative element C-5 were prepared the same as dye-donor element I-9, except that the ethyl cellulose (Ethocel 45) in the dye-donor layer was replaced by the polymers listed in Table 4.

Procedure

Dye-donor elements I-9 through I-13 and Control element C-5 were printed to receiver R-1 the same as for dye-donor element I-1. The print densities were measured the same as for dye-donor element 1, except that the Status A green reflection density of each printed step of the 11-step patch image was measured using an X-Rite Transmission/Reflection Densitometer (model 820; X-Rite Incorporated). The values of the green density at the two different print energies of 0.653 and 1.037 J/cm$^2$ obtained when printing each dye-donor element to receiver R-1 are reported in Table 4.

TABLE 4

| Element | Polymer used in dye-donor layer | Density at 0.653 J/cm$^2$ | Density at 1.037 J/cm$^2$ |
|---|---|---|---|
| I-9 | Ethocel 45 | 0.98 | 2.37 |
| I-10 | Aqualon K50 | 0.95 | 2.25 |
| I-11 | Aqualon N22 | 1.02 | 2.36 |
| I-12 | Aqualon T50 | 1.04 | 2.42 |
| I-13 | Aqualon X22 | 1.12 | 2.40 |
| C-5 | CAP 482-20 | 0.77 | 2.07 |

The above results show that when ethyl cellulose is used as the binder in the magenta dye-donor layer, higher optical print densities can be obtained for the same input energy than what can be obtained when another polymer such as CAP 482-20 is used as the binder in the dye-donor layer. This advantage is critical when printing at faster speeds.

The inventive elements 1-9 through I-13 in Table 4 correspond in dye-donor polymer layer composition to inventive examples I-1P and I-2P Table 1, and show that the high magenta dye partition coefficients for ethyl cellulose dye-donor polymer in combination with the corresponding dye-receiver binder polymers, P values from 4.75 to 8.08, produce high print densities at faster print times.

In contrast, comparative element C-5 in Table 4 corresponds in dye-donor polymer layer composition to comparative examples C-5P and C-6P in Table 1, and demonstrates that the lower magenta dye partition coefficients for CAP-482-20, P values from 1.62 to 1.81, produce lower print densities than the inventive elements at faster print times.

Example 4

Dye-donor Element I-14

A dye-donor element was prepared the same as dye-donor element I-1 except that the dye-donor layer contained the yellow dyes illustrated below as follows: Yellow dye #1 at 0.0785 g/m$^2$ and Yellow dye #2 at 0.0978 g/m$^2$, ethyl cellulose (Ethocel 45, Dow Chemical Company) binder at 0.2283 g/m2, and 2 micron divinyl benzene beads at 0.0037 g/m$^2$ coated from a solvent mixture of 75 wt. % toluene, 20 wt. % methanol and 5 wt. % cyclopentanone.

Yellow dye #1

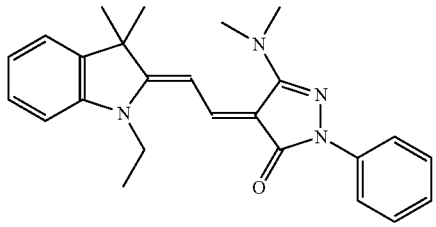

-continued

Yellow Dye #2

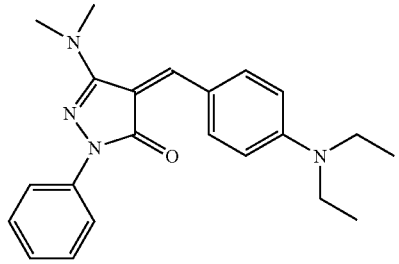

Dye donor element I-14 contains, in addition to the yellow dye #1 found in Table 1, one additional yellow dye having similar structure and solubility. Dye-donor element I-15 was prepared the same as dye-donor element I-14.

Dye-donor Comparative Element C-6

Dye-donor comparative elements C-6 and C-7 were prepared the same as dye-donor elements I-14 and I-15, except that the ethyl cellulose (Ethocel 45) in the dye-donor layers was replaced by CAP-482-20.

Receiver R-2

Receiver R-2 of the composition shown below was prepared, having an overall thickness of about 220 μm and a thermal dye receiver layer thickness of about 3 μm. R-2 was prepared by melt extruding the tie layer and dye receiving layer onto the prepared paper support.

| R-2 |
|---|
| Co-extruded polyester-polycarbonate-silicone dye receiving layer containing Polymer Blend-1 |
| Pelestat 300 (Sanyo Chemical Industries, Ltd.) tie layer |
| Microvoided composite film OPPalyte 350 K18 (ExxonMobil) |
| Pigmented polyethylene |
| Cellulose Paper |
| Polyethylene |
| Polypropylene film |

Procedure

Dye-donor element I-14 and Control element C-6 were printed to receiver R-1 the same as for dye-donor element I-1. Dye-donor element I-15 and Control element C-7 were printed to receiver R-2 the same as for dye-donor element I-1. The print densities were measured the same as for dye-donor element I-1, except that the Status A blue reflection density of each printed step of the 11-step patch image was measured using an X-Rite Transmission/Reflection Densitometer (model 820; X-Rite Incorporated). The values of the blue density at the two different print energies of 0.653 and 1.037 J/cm$^2$ obtained when printing each dye-donor element to receiver R-1 are reported in Table 5.

TABLE 5

| Element | Polymer used in dye-donor layer | Density at 0.653 J/cm$^2$ | Density at 1.037 J/cm$^2$ | Receiver |
|---|---|---|---|---|
| I-14 | Ethocel 45 | 1.20 | 2.24 | R-1 |
| I-15 | Ethocel 45 | 0.96 | 2.22 | R-2 |
| C-6 | CAP 482-20 | 0.95 | 2.11 | R-1 |
| C-7 | CAP 482-20 | 0.71 | 1.95 | R-2 |

The above results show that when ethyl cellulose is used as the binder in the yellow dye-donor layer, higher optical print densities can be obtained for the same input energy than what can be obtained when another polymer such as CAP 482-20 is used as the binder in the dye-donor layer. This advantage is critical when printing at faster speeds.

The inventive element I-14 in Table 5 corresponds in polymer layer composition to inventive example I-3P in Table 1, and shows that the high yellow dye partition coefficient for ethyl cellulose dye-donor polymer in combination with the corresponding dye-receiver binder polymers, a P value of 4.81, produces higher print densities when compared with comparative element C-6 described below. The inventive element I-15 in Table 5 corresponds in polymer layer composition to inventive example I-7P in Table 1, and shows that the high yellow dye partition coefficient for ethyl cellulose dye-donor polymer in combination with the corresponding dye-receiver binder polymers, a P value of 5.43, produces higher print densities when compared with Comparative example C-7P described below.

In contrast, comparative element C-6 in Table 4 corresponds in polymer layer composition to comparative example C-7P in Table 1, and demonstrates that the lower yellow dye partition coefficient for CAP-482-20, a P value of 1.42, produces lower print densities than the inventive element. Comparative element C-7 in Table 5 corresponds in polymer layer composition to comparative example C-11P in Table 1, and demonstrates that the lower yellow dye partition coefficient for CAP-482-20, a P value of 1.74, produces lower print densities than the inventive element.

Example 5

Dye-donor Element I-16

A dye-donor element was prepared the same as dye-donor element I-1 except that the dye-donor layer contained cyan dye #6 whose structure is illustrated above, and the ethyl cellulose (EC-461) in the dye-donor layer was replaced by Butvar B76.

Comparative element C-8 was prepared the same as dye-donor element I-16, except that the ethyl cellulose (EC-461) in the dye-donor layer was replaced by CAP 482-20.

Receiver R-3

Receiver R-3 was prepared in the same manner as Receiver R-1, except that the solvent coated cross-linked polyol dye receiving layer was replaced by a solvent coated Butvar B76 dye receiving layer.

Procedure

Dye-donor element I-16 and Control element C-8 were printed to receiver R-1 the same as for dye-donor element I-1. Control element C-9 was printed to receiver R-3 the same as for dye-donor element I-1. The print densities were measured the same as for dye-donor element 1. The values of the red density at the print energy of 0.653 J/cm$^2$ obtained when printing each dye-donor element to receiver R-1 are reported in Table 6.

TABLE 6

| Element | Polymer used in dye-donor layer | Dye | Density at 0.653 J/cm$^2$ | Receiver |
|---|---|---|---|---|
| I-16 | Butvar B76 | Cyan Dye #6 | 1.30 | R-1 |
| C-8 | CAP 482-20 | Cyan Dye #6 | 1.09 | R-1 |
| C-9 | CAP 482-20 | Cyan Dye #6 | 0.45 | R-3 |

The above results in Table 6 show that when Butvar B76 is used as the binder in combination with Cyan Dye #6 as a dye-donor polymer layer, and printed to Receiver R-1, higher optical print densities can be obtained for the same input energy than what can be obtained when CAP 482-20 is used as the dye-donor layer binder and is printed to the R-1 receiver in Comparative element C-8. This advantage is critical when printing at faster speeds.

The inventive element I-16 in Table 6 corresponds in polymer layer composition to inventive example I-14P in Table 2, and shows that the high Cyan Dye #6 dye partition coefficient for Butvar B76 dye-donor polymer in combination with the corresponding dye-receiver binder polymer, a P value of 4.74, produces higher print densities.

In contrast, comparative element C-8 in Table 6 corresponds in polymer layer composition to comparative example C-25P in Table 2, and demonstrates that the lower Cyan Dye #6 partition coefficient for CAP-482-20, a P value of 1.5, produces lower print densities than the inventive element.

In even greater contrast, comparative element C-9 in Table 6 corresponds in polymer layer composition to comparative example C-31P in Table 2, and demonstrates that an even lower Cyan Dye #6 partition coefficient for CAP-482-20 dye-donor polymer in combination with Butvar B76 dye-receiver polymer, a P value of 0.44, produces the lowest print densities.

The invention has been described in detail with particular reference to certain preferred embodiments thereof, but it will be understood that variations and modifications can be effected within the spirit and scope of the invention.

The invention claimed is:

1. A thermal print assembly comprising a donor having a dye-donor layer having a first glass transition temperature, wherein the dye-donor layer comprises a binder of ethyl cellulose, a hydroxyalkyl cellulose, or a combination thereof and at least one dye, and a receiver having a dye-receiving layer having a second glass transition temperature, wherein the print assembly has a receiver/donor dye partition coefficient of at least 2.5 as measured when the print assembly is heated above the higher of the first or second glass transition temperature for a time sufficient to achieve an equilibrium state of dye distribution between the dye-donor layer and dye-receiving layer, and wherein said print assembly is printed at fast printing speeds of 2 msec/line or less.

2. The thermal print assembly of claim 1, wherein the dye-donor layer comprises one or more 2-carbamoyl-4-[N-(p-substituted aminoaryl)imino]-1,4-naphthaquinone dye, 5-arylisothiazole azo dye, alpha-cyano arylidene pyrazolone dye, aminopyrazolone merocyanine dye, or aminopyrazolone arylidene dye, or a combination thereof.

3. The thermal print assembly of claim 1, wherein the dye-donor layer comprises a tricyanopropene azomethine dye.

4. The thermal print assembly of claim 1, wherein the dye-donor layer of the donor comprises a binder of ethyl cellulose, wherein the ethyl cellulose comprises a first ethyl cellulose with an ethoxyl content of 50.5% or greater, and a second ethyl cellulose with an ethoxyl content of less than 50.5%.

5. The thermal print assembly of claim 1, wherein the dye-donor layer of the donor comprises a binder of hydroxypropyl cellulose, methylhydroxypropyl cellulose, hydroxypropylmethyl cellulose, or a combination thereof.

6. The print assembly of claim 1, wherein the dye-donor layer of the donor comprises one or more 2-carbamoyl-4-[N-(p-substituted aminoaryl)imino]-1,4-naphthaquinone dye, 5-arylisothiazole azo dye, alpha-cyano arylidene pyrazolone dye, aminopyrazolone merocyanine dye, aminopyrazolone arylidene dye, or tricyanopropene azomethine dye, or a combination thereof.

7. The print assembly of claim 6, wherein the dye-receiving layer of the receiver comprises a polycarbonate-containing material, a polyurethane-containing material, a polyester-containing material, a polyvinylacetal-containing material, a poly(vinyl chloride-co-vinyl acetate)-containing material, a poly(ethylene-co-vinyl acetate)-containing material, an acrylic resin, or a combination thereof.

8. The print assembly of claim 1, wherein the dye-receiving layer of the receiver comprises a polycarbonate-containing material, a polyurethane-containing material, a polyester-containing material, a polyvinylacetal-containing material, a poly(vinyl chloride-co-vinyl acetate)-containing material, a poly(ethylene-co-vinyl acetate)-containing material, an acrylic resin, or a combination thereof.

9. The thermal print assembly of claim 1, wherein the partition coefficient is at least 3.0.

10. The thermal print assembly of claim 1, wherein the partition coefficient is at least 4.0.

11. The thermal print assembly of claim 1, wherein the donor comprises a binder of ethyl cellulose, hydroxyalkyl cellulose, or a combination thereof, and one or more 2-carbamoyl -4-[N-(p-substituted aminoaryl)imino]-1,4-naphthaquinone dye, 5-arylisothiazole azo dye, alpha-cyano arylidene pyrazolone dye, aminopyrazolone merocyanine dye, aminopyrazolone arylidene dye, tricyanopropene azomethine dye, or a combination thereof; and the receiver comprises a polycarbonate-containing material, a polyurethane-containing material, a polyester-containing material, a polyvinylacetal-containing material, or a combination thereof.

12. The thermal print assembly of claim 11, wherein the partition coefficient is at least 4.0.

13. The thermal print assembly of claim 1 wherein said print assembly has a receiver/donor dye partition coefficient of at least 2.76 as measured when the print assembly is heated above the higher of the first or second glass transition temperature for a time sufficient to achieve an equilibrium state of dye distribution between the dye-donor layer and dye-receiving layer.

14. The thermal print assembly of claim 1 wherein said print assembly has a receiver/donor dye partition coefficient of at least 4.74 as measured when the print assembly is heated above the higher of the first or second glass transition temperature for a time sufficient to achieve an equilibrium state of dye distribution between the dye-donor layer and dye-receiving layer.

15. A method of printing, comprising:

obtaining a print assembly, wherein the print assembly comprises a donor having a dye-donor layer having a first glass transition temperature, wherein the dye-donor layer comprises a binder of ethyl cellulose, a hydroxyalkyl cellulose, or a combination thereof and at least one dye, and a receiver having a dye-receiving layer having a second glass transition temperature, wherein the print assembly has a receiver/donor dye partition coefficient of at least 2.5 as measured when the print assembly is heated above the higher of the first or second glass transition temperature for a time sufficient to achieve an equilibrium state of dye distribution between the dye-donor layer and dye-receiving layer, and wherein said print assembly is used for printing at fast printing speeds of 2 msec/line or less;

placing the dye-donor layer of the donor adjacent the dye-receiving layer of the receiver; and applying heat in an imagewise fashion to the donor for 2 msec/line or less to form a dye image on the receiver.

16. The method of claim 15, having a print speed of 2.0 msec/line or less.

17. The method of claim 15, wherein the image has a maximum density of at least 2.

18. The method of claim 15, wherein the receiver is formed by extruding the dye-receiving layer onto a support.

19. The method of claim 15, wherein the dye-donor layer comprises one or more 2-carbamoyl-4-[N-(p-substituted aminoaryl)imino]-1,4-naphthaquinone dye, 5-arylisothiazole azo dye, alpha-cyano arylidene pyrazolone dye, aminopyrazolone merocyanine dye, or aminopyrazolone arylidene dye, or a combination thereof.

20. The method of claim 15, wherein the dye-donor layer comprises a tricyanopropene azomethine dye.

21. The method of claim 15, wherein the dye-donor layer of the donor comprises a binder of ethyl cellulose, wherein the ethyl cellulose comprises a first ethyl cellulose with an ethoxyl content of 50.5% or greater, and a second ethyl cellulose with an ethoxyl content of less than 50.5%.

22. The method of claim 15, wherein the dye-donor layer of the donor comprises a binder of hydroxypropyl cellulose, methylhydroxypropyl cellulose, hydroxypropylmethyl cellulose, or a combination thereof.

23. The method of claim 15, wherein the dye-donor layer of the donor comprises one or more of a 2-carbamoyl-4-[N-(p-substituted amino aryl)imino]-1,4-naphthaquinone dye, 5-arylisothiazole azo dye, alpha-cyano arylidene pyrazolone dye, aminopyrazolone merocyanine dye, aminopyrazolone arylidene dye, or a tricyanopropene azomethine dye, or a combination thereof.

24. The method of claim 23, wherein the dye-receiving layer of the receiver comprises a polycarbonate-containing material, a polyurethane-containing material, a polyester-containing material, a polyacetal-containing material, a poly (vinyl chloride-co-vinyl acetate)-containing material, a poly (ethylene-co-vinyl acetate)-containing material, an acrylic resin, or a combination thereof.

25. The method of claim 15, wherein the dye-receiving layer of the receiver comprises a polycarbonate-containing material, a polyurethane-containing material, a polyester-containing material, a polyacetal-containing material, a poly (vinyl chloride-co-vinyl acetate)-containing material, a poly (ethylene-co-vinyl acetate)-containing material, an acrylic resin, or a combination thereof.

26. The method of claim 15, wherein the partition coefficient is at least 3.0.

27. The method of claim 15, wherein the partition coefficient is at least 4.0.

28. The method of claim 15, wherein the donor comprises a binder of ethyl cellulose, hydroxyalkyl cellulose, or a combination thereof, and one or more 2-carbamoyl -4-[N-(p-substituted aminoaryl)imino]-1,4-naphthaquinone dye, 5-arylisothiazole azo dye, alpha-cyano arylidene pyrazolone dye, aminopyrazolone merocyanine dye, aminopyrazolone arylidene dye, tricyanopropene azomethine dye, or a combination thereof; and the receiver comprises a polycarbonate-containing material, a polyurethane-containing material, a polyester-containing material, a polyvinylacetal-containing material, or a combination thereof.

29. The method of claim 28, wherein the partition coefficient is at least 4.0.

* * * * *